United States Patent [19]

Grzesiek et al.

[11] 3,992,845

[45] Nov. 23, 1976

[54] WALL SIDING FASTENERS AND ASSEMBLIES

[75] Inventors: Louis E. Grzesiek, Dana Point, Calif.; William H. Juntunen, Detroit, Mich.

[73] Assignee: Abitibi Corporation, Birmingham, Mich.

[22] Filed: Apr. 2, 1975

[21] Appl. No.: 564,654

[52] U.S. Cl. ..... 52/547; 52/551
[51] Int. Cl.[2] ..... E04D 1/34; E04D 1/12
[58] Field of Search ..... 52/518–560

[56] References Cited

UNITED STATES PATENTS

| | | | |
|---|---|---|---|
| 1,627,429 | 5/1927 | Davis | 52/544 |
| 2,075,602 | 3/1937 | Davey | 52/487 |
| 2,308,129 | 1/1943 | Tummins | 52/544 |
| 2,413,794 | 1/1947 | Small | 52/552 |
| 2,644,410 | 7/1953 | Weber | 52/552 |
| 3,173,229 | 3/1965 | Weber | 52/547 |
| 3,214,876 | 11/1965 | Mattes | 52/546 |
| 3,236,016 | 2/1966 | Koenigshof | 52/548 |
| 3,754,365 | 8/1973 | Carrick et al. | 52/471 |
| 3,866,378 | 2/1975 | Kessler | 52/519 |

FOREIGN PATENTS OR APPLICATIONS

| | | | |
|---|---|---|---|
| 141,044 | 3/1935 | Austria | 52/544 |
| 98,758 | 12/1924 | Austria | 52/552 |
| 240,737 | 1/1946 | Switzerland | 52/539 |

*Primary Examiner*—James L. Ridgill, Jr.
*Attorney, Agent, or Firm*—Cushman, Darby & Cushman

[57] ABSTRACT

This invention relates to wall siding assemblies, particularly to horizontal siding panels and to improved clip means for connecting same to the sides of a building structure. Each siding panel has two elongated recesses or grooves on its backface near the bottom edge of the panel, one recess being nearer the bottom end than the other, with a resilient clip having opposite end portions located in the respective recesses such that the clip is retained in engagement with the panel. The clip has a support leg extending therefrom. Each successive panel is assembled on top of a lower panel already secured to the wall, by positioning the support leg of the clip in engagement with the upper edge of the lower panel, with the lower portion of the upper panel overlapping the upper edge of the lower panel. The upper edge of the newly installed panel is then secured to the wall, for example, by nailing. The clips are easily assembled with the panels, and installation is a very simple matter.

10 Claims, 6 Drawing Figures

WALL SIDING FASTENERS AND ASSEMBLIES

This invention relates to wall siding assemblies, particularly to horizontal siding panels and to improved clip means for connecting same to the sides of a building structure. It has been common practice for many years to attach horizontal siding panels to the walls of houses and other buildings, and the siding panels have been attached to the walls in many different ways. Siding panels should be attachable in a simple, efficient and safe manner, and the attachment should be long-lasting and hence able to withstand a variety of weather conditions.

A main object of the invention is to provide means for the "blind" fastening of siding panels to avoid exposed nail heads and to enable the blind fasteners or clips to be field assembled prior to installation as opposed to using the customary factory assembled continuous spline which complicates both the manufacturing operation as well as the packaging method.

According to one aspect of the invention there is provided a wall siding panel assembly including a siding panel having a front face and a back face, the panel having two grooves in the back face near a bottom edge of the panel, one lower groove, being nearer the bottom edge of the panel than the other upper groove, and a resilient clip having opposite end portions located in the respective grooves and frictionally retaining the clip in engagement with the panel, and the clip also having a support leg extending outwardly therefrom for engaging an upper edge portion of the next lower wall siding panel.

According to a further aspect of the invention there is provided a siding panel having a front face and a back face, and top and bottom edges, the panel having two grooves in the back face adjacent the bottom edge of the panel, which recesses comprise a lower groove being nearer the bottom edge than the other upper groove with the lower recess extending inwardly of the panel from the back face in a direction angularly inclined away from the bottom edge of the panel.

According to a further aspect of the invention there is provided a siding clip of a resilient material and having a pair of oppositeend portions and an intermediate portion, said opposite end portions being adapted to enter into spaced apart grooves in a panel and to resiliently engage the walls of the grooves, one of said end portions having a support leg extending therefrom for engaging an upper edge of a preceding or lower course of siding.

According to a further aspect there is provided a siding clip of resilient material having a pair of opposed end portions and an intermediate portion which together define a generally C-shaped cross-section, a first one of said end portions including a leg portion extending inwardly and forwardly therefrom at an acute angle with said intermediate portion for extending into an angularly disposed groove in a panel and the other end portion including an inturned lip having a generally sharp free edge adapted to grip in a further groove of a panel, and a support leg attached to said first one of the end portions such that the support leg lies generally in a plane displaced rearwardly of an imaginary plane passing through said opposed end portions.

According to a typical embodiment of the invention, each siding panel has two elongated recesses or grooves on its backface near the bottom edge of the panel, one groove being nearer the bottom end than the other, with a resilient clip having opposite end portions located in the respective grooves such that the clip is retained in engagement with the panel. The clip has a support leg extending therefrom. Each successive panel is assembled on top of a lower panel already secured to the wall, by positioning the support leg of the clip in engagement with the upper edge of the lower panel, with the lower portion of the upper panel overlapping the upper edge of the lower panel. The upper edge of the newly installed panel is then secured to the wall, for example, by nailing. The clips are easily assembled with the panels, and installation is a very simple matter.

Advantageously, the top edge of each panel is shaped so that it may readily be engaged and secured by the support portion of the clips attached to the next higher course of siding.

The lower groove may extend inwardly of the panel from the backface in a direction which is inclined away from the bottom end of the panel. The end portion of the clip in this recess has a part which is shaped to enter into and bear against a side wall of the lower groove.

The upper groove may have a lower wall which is preferably substantially perpendicular to the back face of the panel. The opposite end portion of the clip in this recess has a terminal edge portion or lip which extends towards the bottom wall of the groove with its free end adapted to engage the lower wall of such groove to hold the clip securely.

A clip with the inventive features described above can be assembled with the panel by inserting its lower end portion fully into the lower groove, and then slightly deforming the clip by applying pressure thereto to insert its opposite end portion into the upper groove for engagement with the lower wall of the groove.

Embodiments of the invention will now be described, by way of example, with reference to the accompanying drawings, of which:

Figure 1:
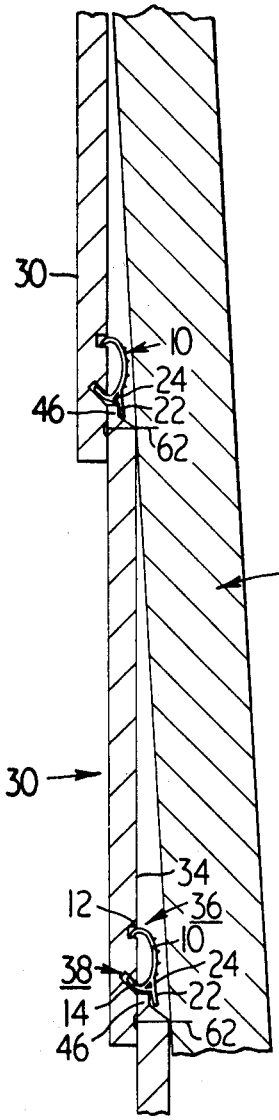
FIG. 1 shows a side view of a series of panel and clip assemblies secured to a wall.
Figure 2:
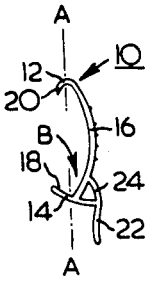
FIG. 2 is a side elevation view of a clip in accordance with one aspect of the invention.
Figure 3:
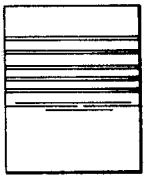
FIG. 3 is a rear elevation view of the clip.

Referring to the drawings FIGS. 2 and 3, the clip 10, which is of a durable thermoplastic material, is generally C-shaped as seen in a side elevation view and includes opposing end portions 12 and 14 and a curved intermediate section 16, end portion 12 being uppermost and end portion 14 being lowermost when the clip is in the installed position as seen in FIG. 1. End portion 14 includes a generally inwardly and forwardly extending leg portion 18 which forms an acute angle with the curved intermediate portion 16 the function of which leg portion will be described hereafter. End portion 12 includes a lip 20 directed generally toward said leg portion 18 and defining a generally sharp free edge portion for frictional engagement with a panel as hereinafter described. The clip 10 also includes a support leg 22 extending outwardly from the lower end portion 14 of the clip. Support leg 22 is connected to the body of the clip via a shoulder portion 24 whereby the leg 22 lies generally in a plane displaced rearwardly of an imaginary plane designated by dashed line A—A in FIG. 2 which passes through opposed end portions 12 and 14 of the clip 10. This rearward displacement of leg 22 enables the support leg 22 to engage an upper edge portion of a panel as will be described hereinafter.

The clips 10 may readily be made by extrusion techniques and are easily cut to a suitable length. The length is not critical although it will be apparent that the holding power of the clip depends, in part, on the length of the clip.

Figure 4:
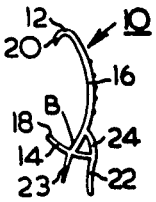
FIG. 4 is a side elevation of a modified version of the clip.

FIG. 4 illustrates a slightly modified version of the clip, the only difference being for the presence of a so-called "vent" tab or leg 23. The vent leg is approximately parallel to support leg 22 and its function is to provide a small spacing, usually in the order of 1/32 inch, between the overlapping portions of each course of siding when installed. This provides a possible avenue for air movement and venting of moisture from behind the siding and is of benefit in climates where entrapped moisture or condensation behind the siding may be a problem.

Figure 6:
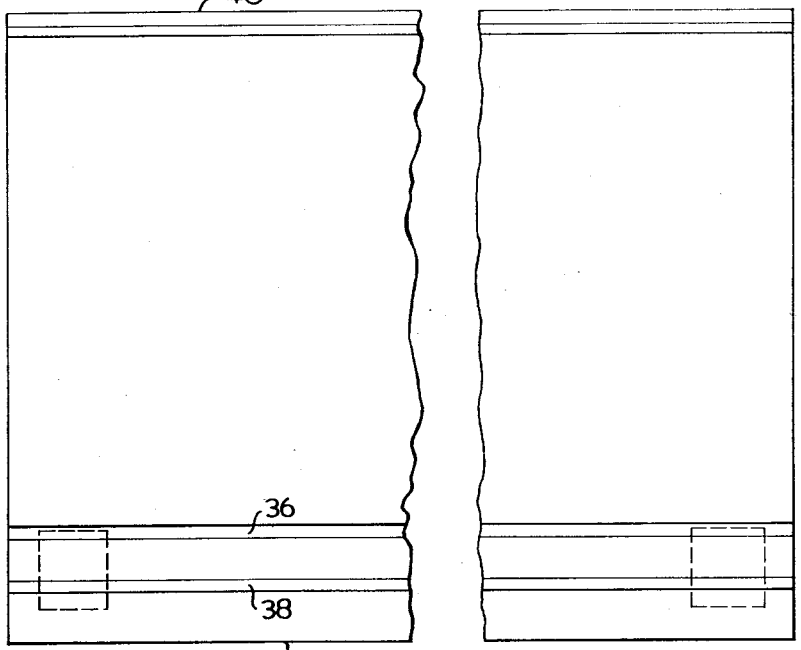
FIG. 6 is a rear view of the panel showing in phantom series of clips assembled therewith.
Figure 5:
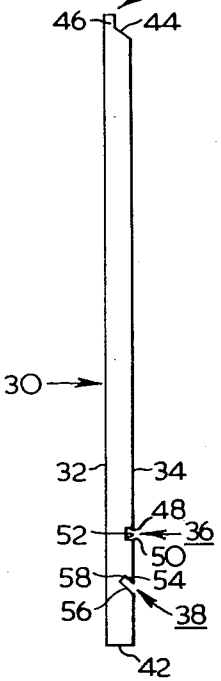
FIG. 5 is an end elevation view of a panel according to a further aspect of the invention.

Each siding panel 30 as seen in FIGS. 1, 5 and 6 is preferably formed from a suitable hardboard, and has front and back faces 32, 34 respectively. The back face 34 has upper and lower grooves 36, 38 respectively which extend along the panel parallel to each other and to the top and bottom edges 40, 42 respectively of the panel. The top edge 40 is recessed at 44 on its rear face to provide a relatively narrow tongue portion 46 which, in use, is engaged by the support leg 22 of the clip. The upper and lower grooves 36, 38 are near the bottom edge 42 of the panel.

The upper groove 36 is of rectangular section with upper and lower walls 48, 50 respectively perpendicular to the back face 34 and an end wall 52 parallel to the back face 34. The lower groove 38 is also generally rectangular in section but extends inwardly of the back face 34 in a direction which is inclined away from the bottom edge 42 of the panel. The lower groove 38 has upper and lower walls 54, 56 respectively which are parallel to one another, and an end wall 58.

Referring particularly to FIGS. 1, 2 and 4, each clip 10 is assembled with a panel 30 by initially inserting the lower leg portion 18 into the lower groove 38 as far as it will go i.e. until the back face 34 engages area B on the concave surface of intermediate portion 16 near the root of leg portion 18. At this stage, the free edge portion defined by lip 20 at the upper end portion 12 of the clip is slightly below the bottom wall 50 of the upper groove 16.

To complete the assembly of the clip with the panel 30, the clip 10 is resiliently deformed by pressing inwardly on the convex intermediate portion 16 of the clip to flatten the clip slightly and to cause the upper end portion 12 to enter the upper groove 36, until the end portion 12 lies against the side wall 52 and the free edge portion 20 engages the lower wall 50 at a position immediately adjacent the end wall 52. Because of the resiliency of the clip the sharp free edge portion 20 bites firmly into the lower wall 50 of the upper groove while at the same time leg portion 18 is securely retained in the angularly inclined lower groove 38 thus retaining the clip 10 firmly engaged with the panel 30.

The clip 10 is now firmly assembled with the panel 30 by frictional engagement of the upper and lower end portions 12, 14 respectively of the clip in the upper and lower grooves 36, 38 respectively of the panel. It will be noted that the support leg 22 extends downwardly generally parallel to the rear face of panel 30 but spaced therefrom a distance sufficient to allow the tongue 46 on the upper edge of the next lowest course of siding to be snugly received between the support leg 22 and the back face of the panel with the upper edge of the tongue bearing against the previously described shoulder 24.

As shown in FIG. 6 a series of clips 10 (shown in phantom) are secured to each panel 30 in spaced relationship with each other.

FIG. 1 shown a series of three panel and clip assemblies secured to a wall 60 of a building structure. Each successively higher panel 30 has the support portions i.e. shoulder 24 support leg 22 of its clip 10 resting on and engaged with the tongue 46 at the upper edge of the panel immediately therebelow. The upper edge portion of each panel 30 is secured to the wall 60 by nails 62 which are driven in immediately after each successive panel is engaged with the panel immediately therebelow. The lowest panel 30 rests upon a starter strip (not shown) of appropriate dimensions, similar to the upper end portion of a panel but increasing in thickness downwardly to give the lowest panel the correct inclination to the wall 60. It will of course be noted that the lower edge portion of each panel overlaps the upper edge portion of the lower panel in customary fashion.

Both the clips 30 and the nails 62 are protected from the weather. Also, the forces on the clips 10 due to the weight of the panel to which they are secured, cause the clips 10 to be retained even more firmly in the upper and lower grooves 36, 38 with the upper end 12 tending to be thrust into the upper groove 36 at all times and the leg portion 18 being firmly thrust into the inclined lower groove 38.

We claim:

1. A siding clip of resilient material including a pair of opposed end portions and an intermediate portion which together define a generally C-shaped configuration when said clip is seen in side elevation, one of said opposed end portions including a leg portion extending inwardly and forwardly therefrom at an acute angle with respect to said intermediate portion for extending into and engaging in an angularly disposed recess in a panel and the other end portion including an inturned lip directed generally toward said leg portion and having a generally sharp free edge adapted to resiliently grip a wall of a further recess of a panel, the clip further including a support leg adapted to engage an upper edge of a further panel, said support leg disposed such that at least a portion of same lies generally in a plane displaced rearwardly of an imaginary plane passing through said opposed end portions.

2. A siding clip according to claim 1 wherein said support leg is connected adjacent the end portion having said leg portion by means of a shoulder portion which is adapted to rest on an upper edge of a lower course of siding while said leg engages behind said upper edge in the operative position of said clip.

3. A siding clip according to claim 1 further including a vent leg which is generally parallel to and spaced forwardly of said support leg for maintaining a slight gap between adjacent overlapping courses of siding in the operative position of the clip.

4. A wall siding panel assembly including an elongated siding panel having a front face, a back face, a top edge and a bottom edge, the panel having a first groove and a second groove in the back face extending lengthwise of the panel generally parallel to and adjacent said bottom edge of the panel, said second groove being nearer the bottom edge of the panel than said first groove, said second groove extending inwardly of the panel from the back face in a direction which is inclined away from the bottom edge of the panel, and said first groove having a first wall, and a siding clip in a resiliently deformed condition having first and second opposed end portions, with said clip end portions being urged towards one another by virtue of the resiliency of the clip, said second end portion of the clip including an angularly arranged leg portion extending into said inclined second groove, the first end portion of the clip being disposed in the first groove and having a lip portion directed generally toward said leg portion and terminating at a free edge engaging said first wall of the first groove, whereby said angularly arranged leg portion and said lip portion are securely engaged in said second groove and said first groove respectively thereby to retain said clip in engagement with said panel, and the clip further including a support leg extending therefrom and adapted to engage behind a top edge portion of a next lower wall siding panel when the siding panel assembly is installed on a wall of a structure.

5. A panel assembly according to claim 4 wherein the support leg extends from the clip in a direction towards the bottom edge of the panel and in spaced relation to said back face of the panel to enable a top edge portion of the next lower siding panel to be engaged between said support leg and said back face of the panel.

6. A panel assembly according to claim 4 wherein said second groove has upper and lower walls with said inclined leg portion of the clip bearing against said upper wall.

7. A panel assembly according to claim 4 wherein a plurality of said siding clips are provided in spaced apart relation along the lengths of the first and second grooves.

8. A siding clip adapted to engage in first and second spaced parallel grooves in a back face of a wall siding panel wherein the second groove extends inwardly of the panel in a direction angularly inclined away from a bottom edge of the panel; said siding clip being of a resilient material and including a pair of opposed end portions and an intermediate portion, one of the end portions having a leg portion extending forwardly relative to the intermediate portion at an acute angle relative to the intermediate portion and adapted to be received in the second groove of the panel, and the other of said opposed ends adapted to be received in said first groove and having a lip portion directed generally toward said leg portion and terminating in a free edge adapted to bite into a wall of the first groove in the panel, the clip further including a support means disposed rearwardly of the intermediate portion and adapted to engage behind an upper portion of a further siding panel located below the first mentioned siding panel.

9. The siding clip according to claim 8 wherein said support means is connected adjacent the clip end portion having said leg portion, said support means including a leg portion displaced rearwardly of an imaginary plane passing through said opposed end portions and generally parallel thereto.

10. The siding clip according to claim 9 further including a vent leg generally parallel to said support leg and spaced forwardly thereof a sufficient distance as to enable the upper portion of the further siding panel to be received between the vent leg and the support leg.

* * * * *